US007310916B2

(12) United States Patent
Gorman

(10) Patent No.: US 7,310,916 B2
(45) Date of Patent: Dec. 25, 2007

(54) WAVE SHIM AND METHOD OF SHIMMING

(75) Inventor: Chris Gorman, Fort Lauderdale, FL (US)

(73) Assignee: Construction Concepts Unlimited, Inc., Fort Lauderdale, FL (US)

( * ) Notice: Subject to any disclaimer, the term of this patent is extended or adjusted under 35 U.S.C. 154(b) by 370 days.

(21) Appl. No.: 10/727,751

(22) Filed: Dec. 4, 2003

(65) Prior Publication Data

US 2005/0120648 A1 Jun. 9, 2005

(51) Int. Cl.
*E04B 2/82* (2006.01)

(52) U.S. Cl. ..... 52/126.1; 52/741.1

(58) Field of Classification Search ..... 52/98, 52/717.04, 126.1, 126.3, 126.5, 127.2, 127.1, 52/DIG. 1; 403/365, 371; 428/33, 43; 248/188.2; 254/104; 144/193.2; 292/342, 343, 355; 340/546

See application file for complete search history.

(56) References Cited

U.S. PATENT DOCUMENTS 1,552,912 A * 9/1925 Colt ..... 254/104
2,772,596 A * 12/1956 Trussell ..... 411/535
4,232,068 A * 11/1980 Hoh et al. ..... 428/43
D423,909 S * 5/2000 Hartin ..... D8/349
6,159,575 A 12/2000 Rathsack
6,560,934 B1 5/2003 Workman

OTHER PUBLICATIONS

Author not listed: "Grove Structural Shims", Grove Products, Inc., at http://www.groveproductsinc.com/shim_stacks.htm, 2003, one page.
Author not listed: "Grove Structural Shims", Grove Products, Inc., at http://www.groveproductsinc.com/shim_stacks.htm, Aug. 2001, one page.
Author not listed: "Plastic Window Shims", Sommer & Maca Industries, Inc. 2002-2003 catalog, at http://www.somaca.com/ProductDetail.asp?ProductNumber=345-5025, p. 337.
Author not listed: "CPL Plastic Horseshoe Shims", C.R. Laurence Co., Inc., p. 624.

* cited by examiner

*Primary Examiner*—Jeanette Chapman
*Assistant Examiner*—Jessica Laux
(74) *Attorney, Agent, or Firm*—Mayback & Hoffman, P.A.; Gregory L. Mayback; Scott D. Smiley

(57) ABSTRACT

A wave shim and a method of shimming two elements is provided. The method includes inserting between two elements, at least one wave shim, which is a wave-shaped compressible body with a slot subdividing a portion of the body at the end into a pair of wave-shaped extending arms, and a tab attached to the body at a side opposite the wave-shaped extending arms. The shim has an area of reduced body material at a junction point between the tab and the body so that the tab can be broken off, and at least one area of reduced body material exists at corresponding locations along each of the wave-shaped extending arms so that the length of the arms can be reduced. The tab and arms define through-holes and grooves, which can be used in conjunction with a guide-line to align several elements.

21 Claims, 6 Drawing Sheets

WAVE SHIM AND METHOD OF SHIMMING

BACKGROUND OF THE INVENTION

1. Field of the Invention

The invention relates primarily to shims used in construction projects. More specifically, the present invention is directed to a shim and method of using a shim that can easily be placed within a gap.

2. Description of the Related Art

In building construction, walls are commonly constructed with rough openings, which are provided for the subsequent installation of doors, windows, or a variety of other construction items. The walls are most commonly constructed from either wood, cement block, or poured concrete, with most commercial or community-living construction projects utilizing poured concrete. The materials used for walls in residential construction may vary based on geographic location, but are most often wooden frame, cement block, or a combination of both.

Doors and windows intended to fill the rough openings are often pre-manufactured at the factory to meet the specifications of the builder. To allow for installation of the doors and windows, the builder must make the openings in the building slightly larger than the object that is to be inserted into the particular opening. Due to tolerances in materials, human error, and other factors, the walls of the rough openings may not be true and the intersections of the walls often do not meet at perfect 90-degree angles. These unpredictable variances add to the difficulty of installing the pre-manufactured doors and windows.

The installation of a door or window is as follows: The frame is inserted into the rough opening in a particular wall. Because the frames are slightly smaller than the rough opening, relatively small gaps exist between the outside surfaces of the frame and the corresponding inside surfaces of the walls of the rough opening. The direction "inside" refers to a direction toward a center region of the rough opening. Similarly, the direction outside refers to a direction opposite the center region. To fill the gaps between the frame and the opening, material is placed between the frame and the corresponding inside surface of the opening. The material placed in the gaps is referred to as a "shim," and is utilized to bridge the gap between the wall and the frame and bring the two into physical communication with each other. Different amounts of shim material are used at various shim points around the frame to account for dimensional variances in the rough opening in the wall. The result is a frame that is physically supported and level. The frame is then secured to the wall using common nails, screws, bolts, or other similar methods of attachment. Although several attachment methods are suitable, the use of screws will be referred to hereafter.

If the shims are placed more than a few inches away from a point where the installation screw attaches the frame to the opening in the wall, the pressure exerted by the head of the screw on the relatively thin frame material, usually aluminum, as the screw is turned, will flex and distort the frame. It is therefore desirable to place the shims, among other places along the frame, as close as possible to the screws. One method, as is done in the prior art, is to provide a U-shaped shim that will slide around and contain the screw within its channel. This provides a solid base between the inside surface of the wall of the rough opening and the outer surface of the frame. As a result, the frame will not distort under normal pressure when the screw is tightened.

The size of the gap between the frame and the rough opening may vary along the length of the opening. It is therefore desirable to have a shim that varies in thickness, or a plurality of shims that can be stacked to achieve the particular desired thickness.

Several prior art shims exist that have the above-mentioned features. For example, U.S. Pat. No. 6,560,934 to Workman, describes a horseshoe-shaped shim that can fit around a screw or bolt and also has the feature of being snappably connectible to adjacent shims through upwardly extending projections on a surface of a first shim and corresponding recessed areas on a second shim. Workman however, has several disadvantages. When installed between two vertical elements, the Workman shim must be installed around an installation screw or bolt and be aligned so that the open end of its horseshoe shape faces in a downward direction. Otherwise, the shim will not stay in its intended position and will fall off of the installation screw or bolt. The shims may also rotate with the screw during the tightening step and can slip or dislocate. Secondly, the Workman shims are difficult to install around the installation screws or bolts because they are concealed behind the frame and are not provided with an easy way to insert them between the rough opening and the frame once the frame is in place. Finally, the Workman shims are not suitable for placement between two vertical elements not having a screw or bolt to support them, because they will dislocate without a structure to hold them in place.

U.S. Pat. No. 6,159,575 to Rathsack discloses a shim having arms defining an insert slot with an inner edge formed with an outwardly directed bevel forming an insert aid. The bevels help grip the installation screw and allow the shim to stay in place while the screw is tightened and the shim is compressed between the frame and the rough opening. Additionally, the bevels allow the shim to be installed in any orientation, with regard to the open end of the shim, without later becoming dislocated. However, the bevels only allow the shims to hold their position when the shims are installed around a screw, bolt, or other similar mounting structure. It is often necessary however, to insert a shim that will maintain its position between structures forming a gap that does not contain a screw, bolt, or other similar mounting structure. The bevels on the Rathsack shim will not be useful in this location. The Rathsack shim also suffers from the same deficiency as does the Workman shim. When placed within a gap defined by two vertically oriented elements, without a mounting structure, the shim will have a tendency to fall and dislocate. Additionally, neither the Rathsack nor Workman shims provide an attachment that allows the shim to easily be inserted completely within the gap.

A shim produced by Grove Products, Inc. and described in their 2003 catalog, found at http://www.groveproductsinc.com/shim_stacks.htm, and a similar shim described in the Sommer & Maca Industries, Inc. 2002-2003 catalog, found at http://www.somaca.com/Product Detail.asp?ProductNumber=345-5025, disclose respective plastic and a PVC shims having a general horseshoe shape with two arms defining an insert slot. At the portion of the shim opposite the extending arms is a rectangular tab. The tab is provided as a method for completely inserting the shim between a gap where the installer's fingers may not fit. In the Sommer & Maca shim, the tabs are provided at their base, which is the connecting junction to the main body of the shim, with a decreased thickness of the material. This decreased area allows the tab to easily snap off of, and away from, the body of the shim once the shim is fully inserted between the gap. Additionally, both publications disclose a shim that has multiple perforations at locations along the arms, which span the width of the arms in a direction perpendicular to the insert slot defined by the arms. The perforations allow the length of the arms to be reduced by simply applying a bending pressure to the arm near one of the perforation points, which will cause a section of the arm to break away from the body of the shim.

The published shim designs also disclose shims that are provided in attached stacks of multiple shim elements. The stacks may be snapped apart to achieve the desired thickness of the gap to be filled with the shim.

Neither the Sommer & Maca, Grove Products, nor any of the shim designs described above, provide a shim that can easily be placed within a gap, is self-tensioning between the gap, and will hold its inserted position without reliance on supporting structure other than the elements defining the gap itself.

SUMMARY OF THE INVENTION

It is accordingly an object of the invention to provide a shim and method of shimming that overcomes the hereinabove-mentioned disadvantages of the heretofore-known devices of this general type and that can easily be placed within a gap, is self-tensioning between the gap, and will hold its inserted position without reliance on supporting structure other than the elements defining the gap itself.

With the foregoing and other objects in view, there is provided, in accordance with the invention, a shim having a wave-shaped compressible body with a slot subdividing a portion of the body at the end into a pair of wave-shaped extending arms.

In particular, it is an object of the invention to provide a shim that is self-tensioning between the gap and will hold its inserted position without reliance on supporting structure other than the elements defining the gap itself.

While the object of the invention is to bridge any gap, for clarity of discussion, the remainder of the specification will refer only to window frames installed in a rough opening in a wall.

With the foregoing and other objects in view, there is provided, in accordance with the invention, a shim having a general horseshoe shape and a generally uniform thickness, with two rectangular arms defining a rectangular insert slot and a body, which connects the two arms and terminates the slot and has extending from it, in a direction opposite the insert slot, a breakaway tab used for, among other things, inserting the shim.

In accordance with an added feature of the invention, the shim is formed in a wavelike configuration with portions of the shim being peaks and other portions being troughs, where the material and thickness of the body is selected so that the body has an elasticity and the peaks and troughs of the waves will exert positive outward pressure when compressed.

In accordance with an additional feature of the invention, at least one of the extending arms, having an upper face and a lower face, is provided with at least one hole penetrating from the upper face to the lower face.

In accordance with yet another feature of the invention, at least one of the extending arms, having an upper face and a lower face, is provided with at least one groove penetrating from the upper face to the lower face.

In accordance with yet a further feature of the invention, the body of the shim, having an upper face and a lower face, is provided with at least one hole penetrating from the upper face to the lower face.

In accordance with yet an added feature of the invention, the tab has an edge, a first surface perpendicular to the edge, and a second surface opposite the first surface, the tab defining at least one groove extending from the edge of the tab in a direction toward a center region of the tab, with the groove being a complete void of material from the first surface to the second surface.

In accordance with yet another added feature of the invention, the tab has a first surface and a second surface opposite said first surface, and the tab defines at least one through-hole running from the first surface to the second surface.

In accordance with yet an additional feature of the invention, the shim can be attached to, and used in conjunction with, one or more additional shims to achieve a range of necessary thicknesses.

In accordance with again another feature of the invention, the shim is provided with a line of perforations, or a line having less material than the adjacent areas, where the tab meets the body area.

In accordance with again a further feature of the invention, the shim is provided with a line of perforations, or a line having less material than the adjacent areas, at one or more locations on each of the extending arms.

In accordance with still a further feature of the invention, a plurality of shims can be removably attached to each other by using a small amount of glue or epoxy, or by melting a portion of the edges of the shims to each other.

With the objects of the invention in view, there is also provided a method for bridging a gap between two elements by inserting a shim having a body formed in a wavelike configuration with portions of the shim being peaks and other portions being troughs, where the material and thickness of the body is selected so that the body has an elasticity and the peaks and troughs of the waves will exert positive outward pressure when compressed and the shim will remain in its installed orientation without the necessity of additional forces.

In accordance with a further mode of the invention, the shim is inserted within a gap defined by two elements by holding the shim by its tab and subsequently separating the tab from the shim by bending it away from the plane of the body of the shim once the shim is fully inserted into the gap.

In accordance with an added mode of the invention, portions are removed from the end of the extended arms of the shim by bending the portions away from the plane of the body of the shim at areas having lines of reduced body material.

In accordance with an additional mode of the invention, at least two elements are aligned by inserting into at least two different gaps defined by, at least two sets of elements, at least two shims including a wave-shaped body with a slot subdividing a portion of the body at the end into a pair of wave-shaped extending arms, and a tab attached to the body at a side opposite the wave-shaped extending arms, the tab having an edge, a first surface perpendicular to the edge, and a second surface opposite the first surface, with the tab defining at least one groove extending from the edge of the tab in a direction toward a center region of the tab, and the groove comprising a complete void of material from the first surface to the second surface, and then connecting a guideline from the groove in the first shim to the corresponding groove in the at least one other shim, and finally moving at least one of the elements to achieve alignment between the elements.

In accordance with yet another mode of the invention, at least two elements are aligned by inserting into at least two different gaps defined by, at least two sets of elements, at least two shims having a wave-shaped body with a slot subdividing a portion of the body at the end into a pair of wave-shaped extending arms, and a tab attached to the body at a side opposite the wave-shaped extending arms, with the tab having a first surface and a second surface opposite said first surface, and the tab defining at least one through-hole running from the first surface to the second surface, and then threading a guide-line through the hole in the tab of the first shim to the corresponding hole in the tab of the at least one other shim, and finally moving at least one of the elements to achieve alignment between the elements.

In accordance with yet a further mode of the invention, at least two elements are aligned by inserting into at least two different gaps defined by, at least two sets of elements, at least two shims having a wave-shaped body with a slot subdividing a portion of the body at the end into a pair of wave-shaped extending arms having an edge, a first surface perpendicular to the edge, and a second surface opposite the first surface, with at least one of the extending arms defining at least one groove extending from the edge of the extending arm in a direction toward a center region of the extending arm, and the groove comprising a complete void of material from the first surface to the second surface, and then connecting a guide-line from the groove in the at least one extending arm of the first shim to the corresponding groove in the at least one extending arm of the at least one other shim, and finally moving at least one of the elements to achieve alignment between the elements.

In accordance with yet an added mode of the invention, at least two elements are aligned by inserting into at least two different gaps defined by, at least two sets of elements, at least two shims having a wave-shaped body with a slot subdividing a portion of the body at the end into a pair of wave-shaped extending arms having a first surface and a second surface opposite said first surface, and at least one of the extending arms defining at least one through-hole running from the first surface to the second surface, and then threading a guide-line through the hole in the at least one extending arm of the first shim to the corresponding hole in the extending arm of the at least one other shim, and finally moving at least one of the elements to achieve alignment between the elements.

Other features that are considered as characteristic for the invention are set forth in the appended claims.

Although the invention is illustrated and described herein as embodied in an apparatus and method of bridging gaps between elements, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

Further objects and advantages of the present inventions can be found in the description of the preferred embodiments when taken in conjunction with the accompanying drawings in which.

DESCRIPTION OF THE PREFERRED EMBODIMENTS

Figure 1:
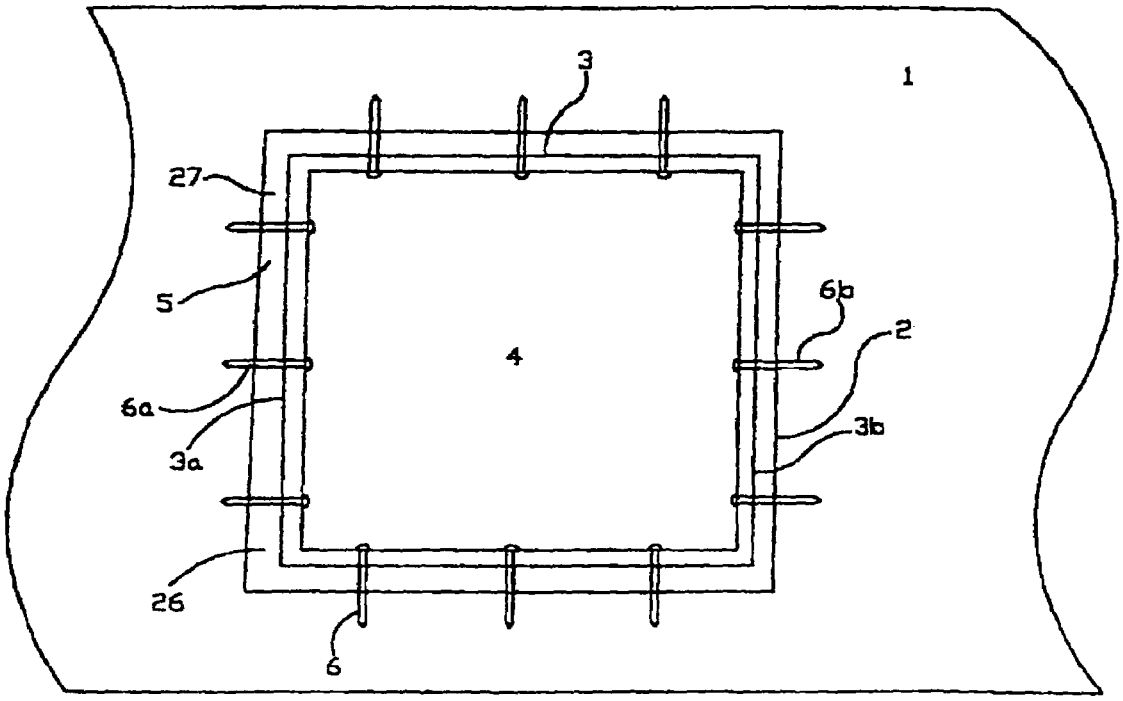
FIG. 1 is a fragmentary, diagrammatic, front-elevational view of a window and frame mounted in a rough opening in a wall.

Referring now to the figures of the drawings in detail, and in particular to FIG. 1, there is illustrated a wall 1 with a rough opening 2 formed in the wall 1. Inside the rough opening 2 is a frame 3, which surrounds the periphery of a windowpane 4. The frame 3 is attached to the rough opening 2 with screws 6. As can be seen, there is a gap 5 between the rough opening 2 and the frame 3. The gap 5 is not entirely uniform around the frame 3. Looking at the left side of the rough opening 2, the distance between the rough opening 2 and the frame 3 is greater at a lower portion 26 of the opening than at an upper portion 27 of the opening 2.

Screws 6 attach the window 4 and the frame 3 to the opening 2 in the wall 1. It is desirable when installing windows to locate the windows in the center of the opening in the wall. It is a difficult endeavor, however, to hold a window 4 and a frame 3 in midair and drive the screws 6 through the frame 3 and into the wall 1 while maintaining the window 4 position in the center of the opening 2. The present invention is utilized between the frame 3 and the opening 2 to position the frame 3 in the center of the opening and to present a frame and window that are level with the floor.

Figure 2A:
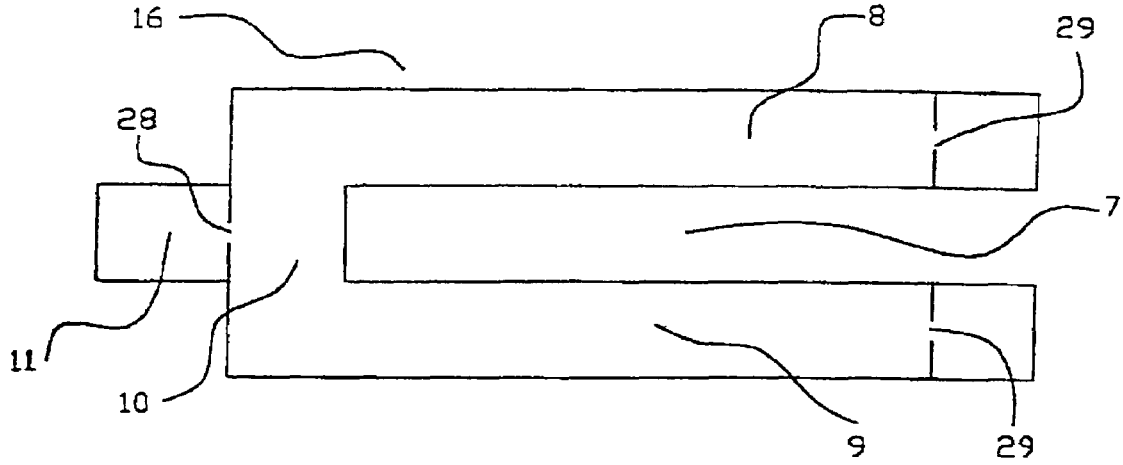
FIG. 2A is a perspective diagrammatic view of a wave-shaped shim.
Figure 2B:
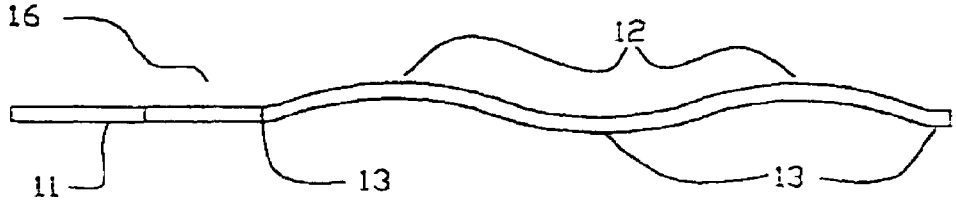
FIG. 2B is a diagrammatic side-elevational view of a wave-shaped shim.

Shim 16, shown in FIG. 2A, is a one-piece wave-shaped compressible body with a slot 7 dividing a portion of the body 10 into a pair of wave-shaped extending arms 8 and 9. Looking at a side view of the shim 16 in FIG. 2B, the extending arms have peaks 12 and troughs 13. A tab 11 is attached to the body 10 at a side opposite the extending arms 8 and 9. An area of reduced material thickness 28 exists at or near a junction point between the tab 11 and the body 10. There is also at least one area of reduced body material 29 at corresponding locations along each of the wave-shaped extending arms 8 and 9.

Figure 3:
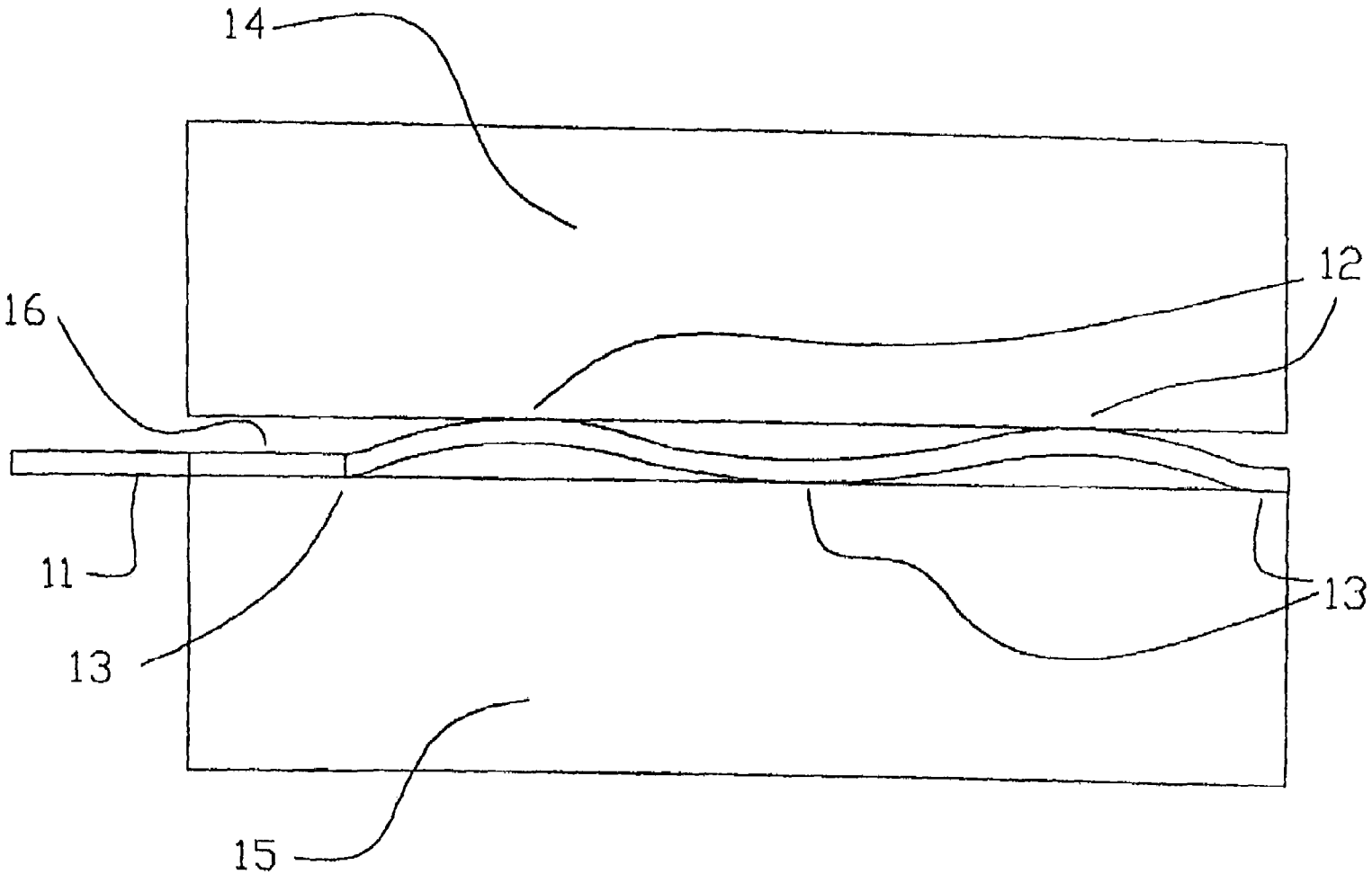
FIG. 3 is diagrammatic cross-sectional view of a wave-shaped shim inserted in a gap between two elements.

Two elements 14 and 15 are shown in FIG. 3. As an illustrative example, element 14 may be an inside edge of a rough opening in a wall and element 15 may be a side edge of a window frame. A gap 30 is defined by the elements 14 and 15 and the shim 16 is inserted between the elements 14 and 15 to fill the gap 30. An inventive feature of the present invention is that only a portion of the gap 30 needs to be filled by the shim 16. The peaks 12 and troughs 13 of the wave-shaped shim 16 make contact with the elements 14 and 15 and bring them into physical communication with each other. The shim 16 is constructed of a material that has an elastic characteristic that will allow the shim 16 to undergo compression without breaking and to continuously exert positive outward pressure on the pressure-causing elements. By inserting shim 16 with a distance between its peaks 12 and troughs 13 greater than the width of the gap 30 between the elements 14 and 15, the shim will be in a compressed state once inside the gap 30 and only the resulting positive outward pressure of the compressed shim 16 is necessary to hold the shim 16 in its inserted position.

Figure 4:
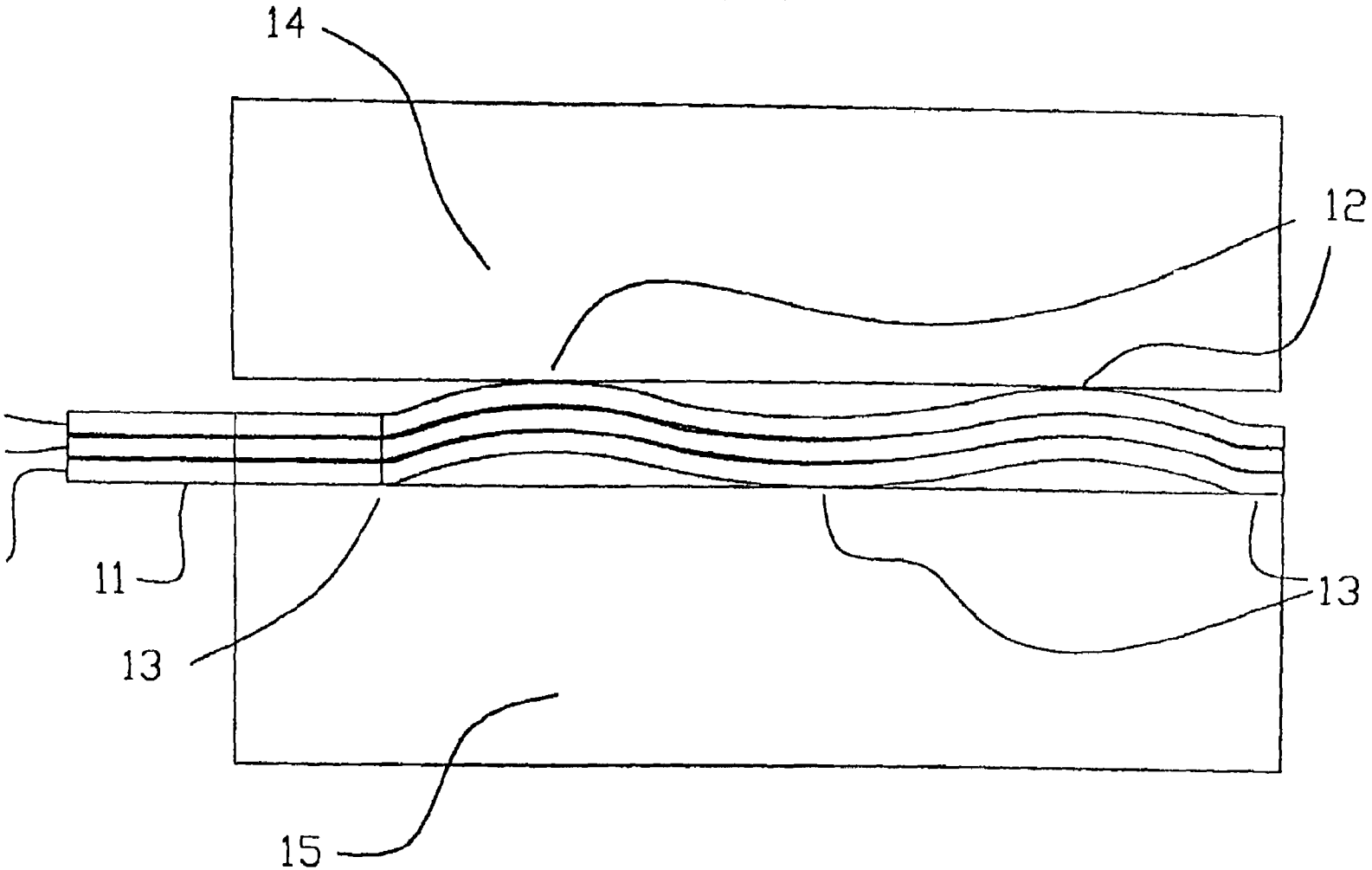
FIG. 4 is a diagrammatic cross-sectional view of multiple wave-shaped shims stacked together and inserted between two elements.

If the width of the gap 30 between the two elements 14 and 15 is greater than the distance between the peaks 12 and troughs 13 of the shim 16, the shim 16 will not hold its position when placed between two vertical elements. In this situation, a plurality of shims can be used in conjunction with each other. FIG. 4 shows shims 16, 24, and 25 inserted between the elements 14 and 15. The added thickness of the shims 24 and 25 allow the shims to fit snugly between the elements 14 and 15 and allow the shims 16, 24, and 25 to hold themselves in the installed position without need for external support. The peaks 12 of the shim 16 and the troughs 31 of the shim 25 make contact with the elements 14 and 15, respectively. The individual shims 16, 24, and 25 can be simply stacked together, or, in a preferred embodiment, the shims can be provided in assemblies of a specified number of connected shims, and shims that will not fit in the intended gap 30 can easily be separated from the assembly.

Additionally, as is shown in FIG. 1, screws 6 oppose each other along the periphery of the window 4. If a set of opposing screws 6, such as screws 6*a* and 6*b* are driven into their respective opposing sides of the opening 2, the gap 5 will allow the frame elements 3*a* and 3*b* to distort near the screw contact points 6*a* and 6*b* and the frame will pull away from the periphery of the window pane 4. Because of its horseshoe shape, the shim 16, when place around a screw, is also utilized to prevent frame distortion when driving the mounting screws through the frame and into the wall. The shim 16 bridges the gap between the wall and the frame and provides a solid base for the portions of the frame surrounding the screw.

Figure 5:
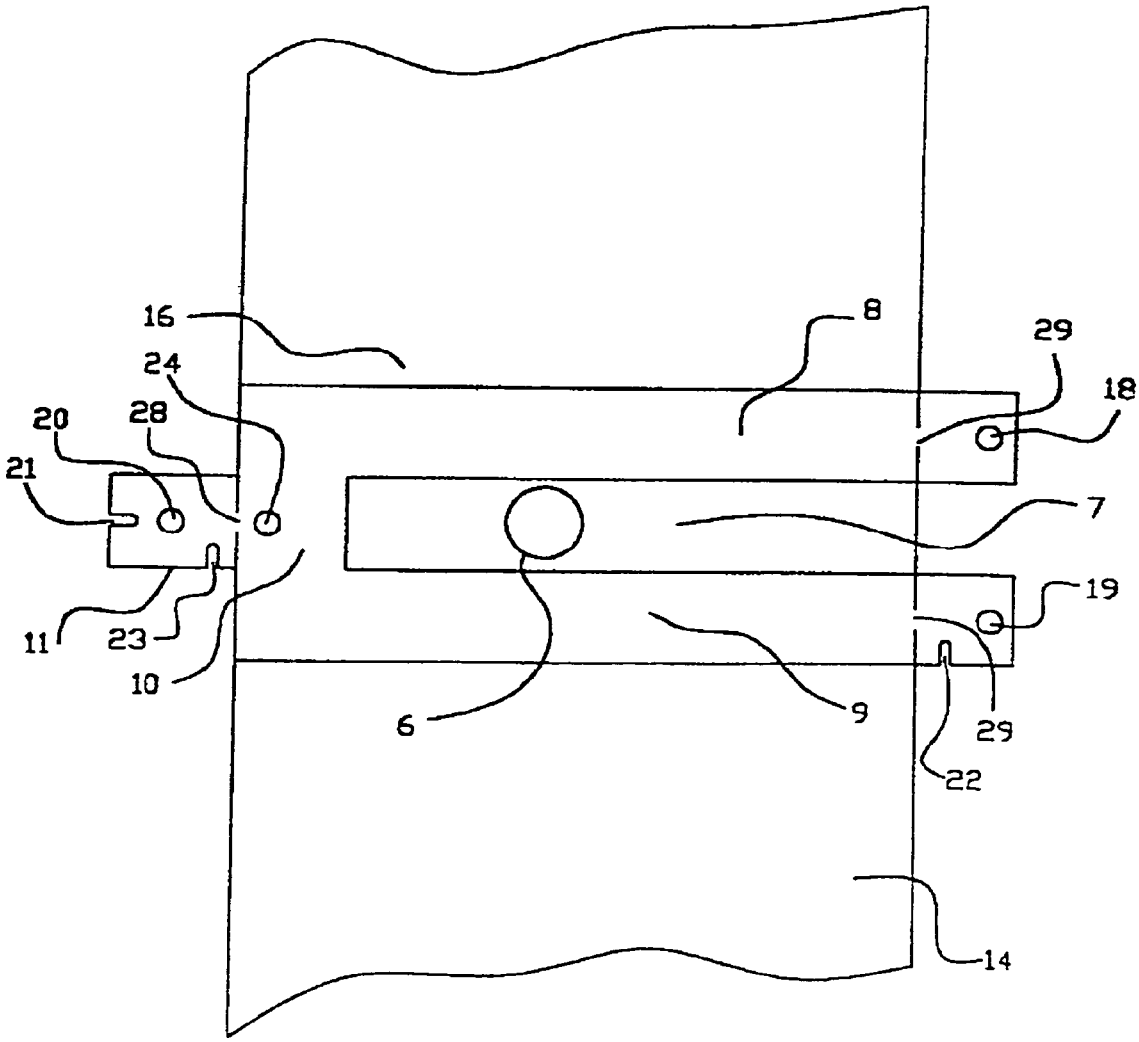
FIG. 5 is a partially sectional, diagrammatic view of a wave-shaped shim, with perforations, holes and groves, inserted in a gap between two elements and around a bolt.

It is common in the construction industry for window frames to be provided in standard widths. In a preferred embodiment, the shims 16 are also provided in standard lengths that match the width of the standard sized frames. In yet another preferred embodiment, the shims are provided in a length to match the largest intended frame dimension in a project and the shim is further provided with areas of reduced material at corresponding locations along each of the wave-shaped extending arms, corresponding to the widths of the available standard sized window frames. As seen in FIG. 5, the shim 16 is inserted in a gap between element 14 and element 15 (not shown). The shim 16 is inserted around a mounting screw 6, which results in screw 6 being located within the slot 7 of shim 16. Arms 8 and 9 are shown extending beyond the edge of elements 14 and 15. The reduced material areas 29 align with the edge of the elements 14 and 15, and lateral pressure, in direction away from the plane of the inside face of element 14, on the portion of arms 8 and 9 extending beyond the elements 14 and 15 will cause the arm portions to become detached from the shim 16 and thus leave the remainder of the shim 16 flush with the edge of the elements 14 and 15.

Shim 16 is also provided with a tab 11 that is utilized by the installer as a method for easily inserting the shim completely within the gap 30. As can be seen in FIG. 5, an area of reduced material 28 is provided at a junction between the body 10 and the tab 11 of the shim 16. Once the shim is properly positioned within a gap, lateral pressure placed against the tab 11, in direction away from the plane of the inside face of element 14, will cause the tab 11 to separate at the area of reduced material 28 and the shim 16 will then be flush with the elements that it is installed between.

Figure 6:
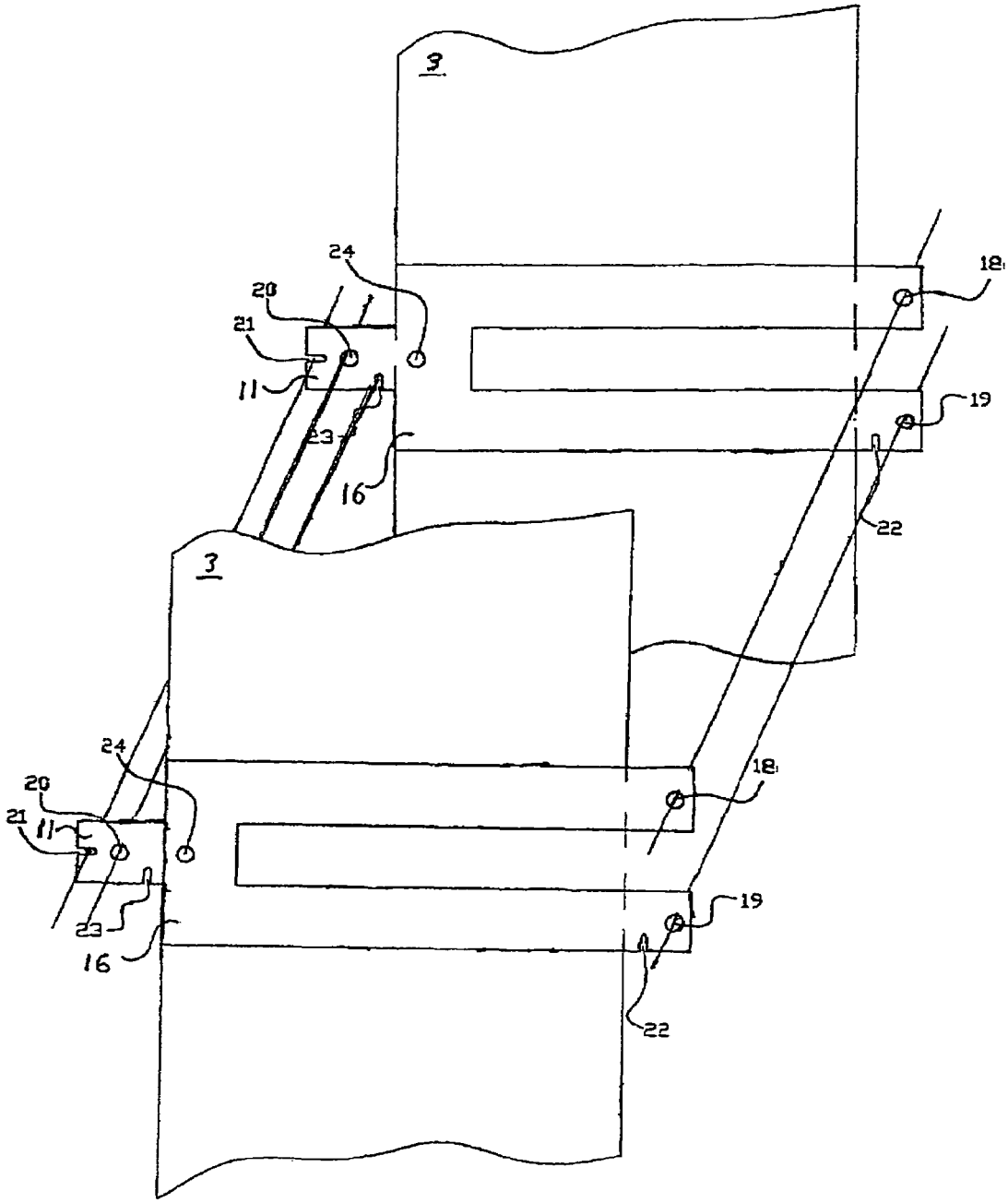
FIG. 6 is a partially sectional, diagrammatic view of a pair of wave-shaped shims, with strings aligning perforations, holes, and groves in the shims.

In a preferred embodiment, the tab 11 will be provided with small grooves 21 and 23, shown in FIG. 5, which extend from the edge of the tab 11 to toward a central portion of the tab. Prior to separating the tab 11, as described in the preceding paragraph, the inserted shims 16 can be utilized to align several frames 3 along a single plane by connecting a guide-line, such as a string, as shown in FIG. 6 through grooves 21 and/or 23 of the tabs 11 of a plurality of shims 16 located between a plurality of frames 3 and rough openings 2. The placement of the frames can be adjusted laterally within the rough openings to achieve a string that runs in a straight line through each of the connected shims. In a similar fashion, as also shown in FIG. 6 through-holes 20, 24, 18, and 19, and slot 22 can be used for alignment of a series of window frames. The through-holes completely penetrate the material of the shim and allow a guide-line to be threaded through the holes to align the frames in a manner similar to that previously described above.

I claim:

1. A shim, comprising:

a body portion; and an arm portion including arms defining a slot therebetween and having:

a transverse extent; and a longitudinal extent longer than the transverse extent and extending longitudinally from the body portion, each arm having a wave shape, the shape and direction of the wave of each arm traveling along the longitudinal extent, the arms being of a thickness and of a material that allows them to compress and elastically return substantially to their initial wave shape after a compressive force is removed; and further comprises a tab attached to said body at a side opposite said wave-shaped extending arms.

2. The shim according to claim 1, wherein said tab is attached to said body via an area of reduced body material at a junction point between said tab and said body.

3. The shim according to claim 1, wherein said tab has an edge, a first surface perpendicular to said edge, and a second surface opposite said first surface, said tab defining at least one groove extending from said edge of said tab in a direction toward a center region of said tab, and said groove being a complete void of material from said first surface to said second surface.

4. The shim according to claim 1, wherein said tab has a first surface and a second surface opposite said first surface, and said tab defines at least one through-hole running from said first surface to said second surface.

5. The shim according to claim 1, wherein at least one area of reduced body material exists at corresponding locations along each of said wave-shaped extending arms.

6. The shim according to claim 1, wherein said body is comprised of a single piece of material.

7. The shim according to claim 1, wherein at least one of said extending arms has an edge, a first surface perpendicular to said edge, and a second surface opposite said first surface, said at least one extending arm having at least one groove formed therein extending from said edge of said extending arm in a direction toward a center region of said extending arm, and said groove comprising a complete void of material from said first surface to said second surface.

8. The shim according to claim 1, wherein at least one of said extending arms has a first surface and a second surface opposite said first surface, and said extending arm is formed with at least one through-hole running from said first surface to said second surface.

9. A shim, comprising:

a body portion; and an arm portion including arms defining a slot therebetween and having:

a transverse extent; and a longitudinal extent longer than the transverse extent and extending longitudinally from the body portion, each arm having a wave shape, the shape and direction of the wave of each arm traveling along the longitudinal extent, the arms being of a thickness and of a material that allows them to compress and elastically return substantially to their initial wave shape after a compressive force is removed and wherein each of the wave-shaped bodies are removably attached to at least one other one of the wave-shaped bodies; and further comprises a tab attached to each of said bodies at a side opposite said wave-shaped extending arms.

10. The shim assembly according to claim 9, wherein said tab is attached to said body via an area of reduced body material on each said body at a junction point between each said tab and each said body.

11. The shim assembly according to claim 9, wherein each of said tabs has an edge, a first surface perpendicular to said edge, and a second surface opposite said first surface, with each said tab defining at least one groove extending from said edge of said tab in a direction toward a center region of said tab, and said groove being a complete void of material from said first surface to said second surface.

12. The shim assembly according to claim 9, wherein each of said tabs has a first surface end a second surface opposite said first surface, and said tab defines at least one through-hole running from said first surface to said second surface.

13. The shim assembly according to claim 9, wherein at least one area of reduced body material exists at corresponding locations along each of said wave-shaped extending arms.

14. The shim assembly according to claim 9, wherein at least one of said extending arms of each body has an edge, a first surface perpendicular to said edge, and a second surface opposite said first surface, with said extending arm defining at least one groove extending from said edge of said extending arm in a direction toward a center region of said extending arm, and said groove comprising a complete void of material from said first surface to said second surface.

15. The shim assembly according to claim 9, wherein at least one of said extending arms of each body has a first surface and a second surface opposite said first surface, and said extending arm defines at least one through-hole running from said first surface to said second surface.

16. A method for shimming an element, which comprises the following steps:

inserting at least one shim into a gap between and defined by the element and an adjacent structure, the at least one shim including:

a body portion; and an arm portion including arms defining a slot there between and having:

a transverse extent; and a longitudinal extent longer than the transverse extent and extending longitudinally from the body portion, each arm having a wave shape, the shape and direction of the wave of each arm traveling along the longitudinal extent, the arms being of a thickness and of a material that allows them to compress and elastically return substantially to their initial wave shape after a compressive force is removed; and further comprises fully inserting the shim between the two elements by utilizing a tab attached to the shim; and subsequently separating the tab from the shim.

17. The method according to claim 16, which further comprises removing a portion of the wave-shaped extending arms that extend from the gap between the two elements after the shim has been inserted.

18. A method for aligning at least two elements, which comprises the following steps:

inserting at least one shim into each of at least two different gaps defined by, at least two sets of elements, the shims including:

a wave-shaped body with a slot dividing a portion of the body at an end thereof into a pair of wave-shaped extending arms, and a tab attached to the body at a side opposite the wave-shaped extending arms, the tab having an edge, a first surface perpendicular to the edge, and a second surface opposite the first surface, the tab defining at least one groove extending from the edge of the tab in a direction toward a center region of the tab, and the groove comprising a complete void of material from the first surface to the second surface;

connecting a guide-line from the groove in a shim in a first of the at least two different gaps to a corresponding groove in a shim in a second of the at least two different gaps; and moving at least one of the elements to achieve alignment between tho elements.

19. A method for aligning at least two elements, which comprises the following steps:

inserting at least one shim into each of at least two different gaps defined by, at least two sets of elements, the shims including:

a wave-shaped body with a slot dividing a portion of the body at an end thereof into a pair of wave-shaped extending arms, and a tab attached to the body at a side opposite the wave-shaped extending arms, with the tab having a first surface and a second surface opposite said first surface, and the tab defining at least one through-hole running from the first surface to the second surface;

threading a guide-line through the hole in the tab of a shim in a first of the at least two different gaps to a corresponding hole in the tab of a shim in a second of the at least two different gaps; and moving at least one of the elements to achieve alignment between the elements.

20. A method for aligning at least two elements, which comprises the following steps:

inserting at least one shim into each of at least two different gaps defined by, at least two sets of elements, the shims including:

a wave-shaped body with a slot dividing a portion of the body at an end thereof into a pair of wave-shaped extending arms having an edge, a first surface perpendicular to the edge, and a second surface opposite the first surface, with at least one of the extending arms having at least one groove formed therein extending from the edge of the extending arm in a direction toward a center region of the extending arm, and the groove comprising a complete void of material from the first surface to the second surface;

connecting a guide-line from the groove in the at least one extending arm of a shim in a first of the at least two different gaps to a corresponding groove in the at least one extending arm of a shim in a second of the at least two different gaps; and moving at least one of the elements to achieve alignment between the elements.

21. A method for aligning at least two elements, which comprises the following steps: inserting at least one shim into each of at least two different gaps defined by, at least two sets of elements, the shims including:

a wave-shaped body with a slot dividing a portion of the body at an end thereof into a pair of wave-shaped extending arms having a first surface and a second surface opposite said first surface, and at least one of the extending arms defining at least one through-hole running from the first surface to the second surface;

threading a guide-line through the hole in the at least one extending arm of a shim in a first of the at least two different gaps to a corresponding hole in the extending arm of a shim in a second of the at least two different gaps; and moving at least one of the elements to achieve alignment between the elements.

* * * * *